US005199355A

United States Patent [19]

Larue

[11] Patent Number: 5,199,355

[45] Date of Patent: Apr. 6, 1993

[54] LOW $NO_x$ SHORT FLAME BURNER

[75] Inventor: Albert D. Larue, Uniontown, Ohio

[73] Assignee: The Babcock & Wilcox Company, New Orleans, La.

[21] Appl. No.: 749,356

[22] Filed: Aug. 23, 1991

[51] Int. Cl.[5] ..... F23C 1/12

[52] U.S. Cl. ..... 110/261; 431/183; 431/187; 431/189

[58] Field of Search ..... 431/186, 189, 182, 183, 431/184, 187, 188, 8; 110/260, 261, 262, 264, 265, 347; 239/456, 451

[56] References Cited

U.S. PATENT DOCUMENTS

| | | | |
|---|---|---|---|
| 710,033 | 9/1902 | Bailey | 110/261 X |
| 823,836 | 6/1906 | Wiemann | 431/186 |
| 1,870,013 | 8/1932 | Keenan, Jr. | 431/186 X |
| 1,976,208 | 10/1934 | Agthe et al. | 431/189 X |
| 2,267,025 | 12/1941 | Grindle | 431/183 X |
| 3,049,085 | 8/1962 | Musat et al. | 110/28 |
| 3,074,361 | 6/1963 | Huge et al. | 110/28 |
| 3,111,271 | 11/1963 | Lofgren | 239/456 X |
| 3,145,670 | 8/1964 | Copian et al. | 110/28 |
| 3,788,796 | 1/1974 | Krippene et al. | 431/2 |
| 3,904,349 | 9/1975 | Peterson et al. | 431/184 |
| 4,157,889 | 6/1979 | Bonnel | 431/182 |
| 4,206,712 | 6/1980 | Vatsky | 110/264 |
| 4,208,180 | 6/1980 | Nakayasu et al. | 431/284 |
| 4,270,895 | 6/1981 | Vatsky | 431/183 |
| 4,333,405 | 6/1982 | Michelfelder et al. | 110/264 |
| 4,380,202 | 4/1983 | LaRue et al. | 110/263 |
| 4,400,015 | 8/1983 | Vatsky | 431/184 |
| 4,412,810 | 11/1983 | Izuha et al. | 431/186 |
| 4,422,389 | 12/1983 | Schröder | 110/264 |
| 4,428,727 | 1/1984 | Deussner et al. | 431/182 |
| 4,479,442 | 10/1984 | Itse et al. | 110/261 |
| 4,545,307 | 10/1985 | Morita et al. | 110/264 |
| 4,654,001 | 3/1987 | LaRue | 431/354 |
| 4,748,919 | 6/1988 | Campobenedetto et al. | 110/264 |
| 4,768,948 | 9/1988 | Hansen et al. | 431/187 |
| 4,836,772 | 6/1989 | LaRue | 431/285 |
| 4,915,619 | 10/1990 | LaRue | 431/284 |
| 4,924,784 | 5/1990 | Lennon et al. | 110/262 X |

FOREIGN PATENT DOCUMENTS

| | | | |
|---|---|---|---|
| 2307399 | 9/1974 | Fed. Rep. of Germany | 239/451 |
| 303226 | 1/1929 | United Kingdom | 110/264 |

OTHER PUBLICATIONS

European Pat. No. 031582, Skoog et al, May 1989.

Developmental Status of B&W's Second Generation Low $NO_x$ Burner-the XCL Burner; A. D. LaRue & M. A. Acree-1987 Jt. Symposium on Stationary Comb. $NO_x$ Control-Mar. 23-26, 1987-New Orleans, La. Sponsored by U.S. EPA & E.P.R.I.-Entire Document.

*Primary Examiner*—Carl D. Price

*Attorney, Agent, or Firm*—Robert J. Edwards; Vytas R. Matas; Eric Marich

[57] ABSTRACT

A burner for the combustion of a fuel plus air mixture comprises a central nozzle pipe having an inner surface with a portion which diverges outwardly. An axially moveable plug is positioned within the nozzle pipe and includes an outer wall with a diverging section extending within the diverging section of the nozzle pipe. By axially moving the plug, the cross sectional area of the space between the diverging surfaces increases and decreases for respectively decreasing and increasing the velocity of the fuel plus air mixture passing through the nozzle space. This reduces the formation of $NO_x$ and the length of the flame produced by the burner.

12 Claims, 1 Drawing Sheet

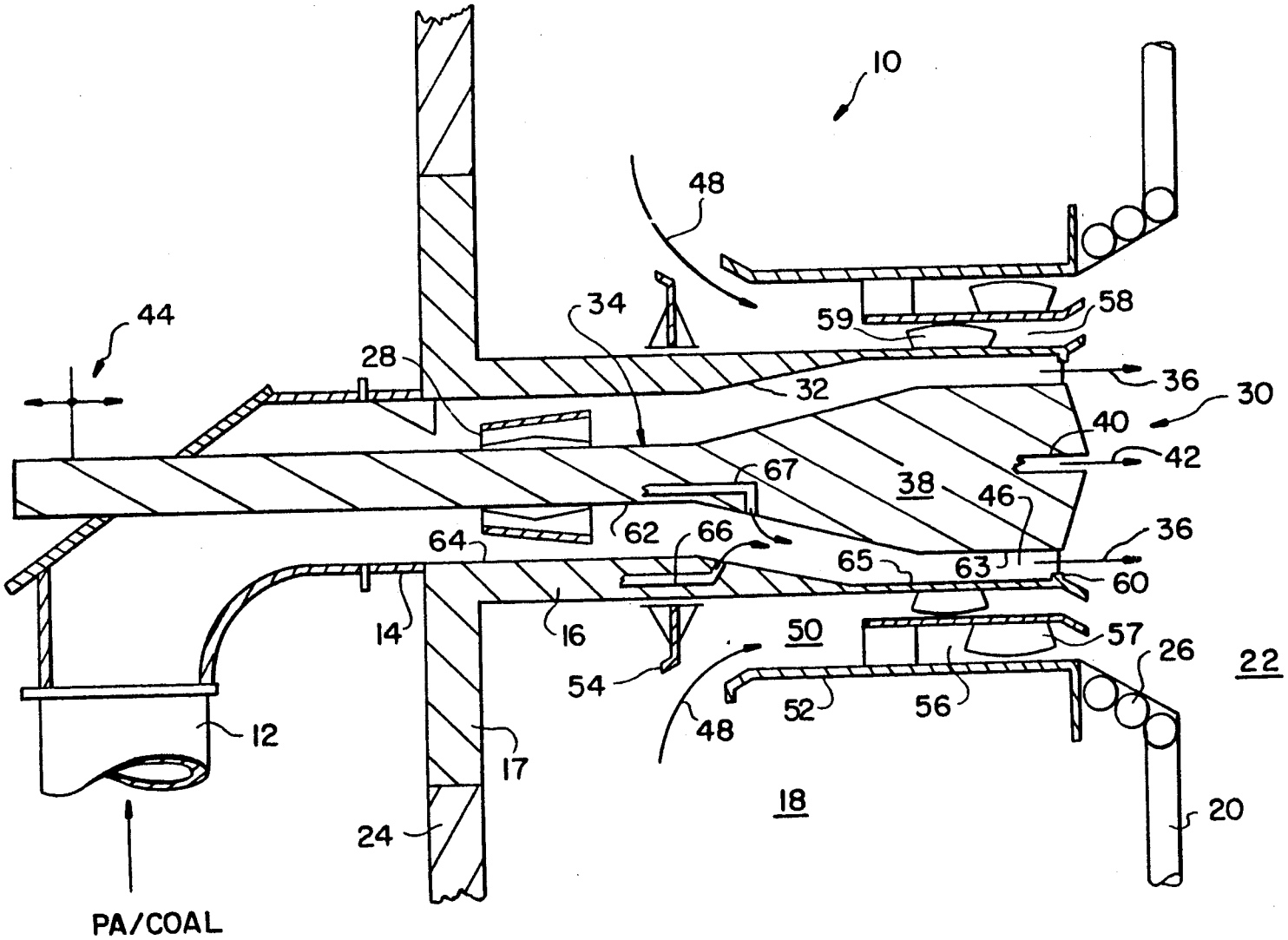
10
12
14
16
17
18
20
22
24
26
28
30
32
34
36
38
40
42
44
46
48
50
52
54
56
57
58
59
60
62
63
64
65
66
67
PA/COAL

LOW $NO_x$ SHORT FLAME BURNER

FIELD AND BACKGROUND OF THE INVENTION

The present invention relates in general to fuel burners, and in particular, to a new and useful burner for the combustion of coal, oil or gas, which simultaneously achieves low $NO_x$ emissions with a relatively short flame.

Low $NO_x$ coal-fired burners rely on principles of air staging and/or fuel staging to reduce formation of nitric oxides during combustion. In either case, it becomes necessary to permit a portion of the combustion process to take place in fuel-rich/oxygen-deficient conditions such that reactions can take place to form $N_2$ rather than NO or $NO_2$. A good example is the burner disclosed in U.S. Pat. No. 4,836,772 which achieves very low $NO_x$ emissions by use of air staging and fuel staging.

Air staging is achieved by a dual air zone burner barrel arrangement which enables regulation of air introduction to the fuel. Consequently, not all the air introduced through the burner is permitted to mix immediately with the fuel, but rather its introduction is controlled to take place gradually.

Fuel staging is achieved by introduction of the fuel in a controlled fuel rich zone, which results in partial combustion and generation of hydrocarbon radicals. These radicals proceed to mix with the products of combustion and reduce $NO_x$ formed earlier in the flame. The combined effects are achieved by introducing the fuel jet axially into the combustion chamber, with sufficient momentum as to delay the mixing between fuel and air. An undesirable attribute of such a burner/process is the relatively long flame which results. Delayed air/fuel mixing tends to cause flames to become much longer than rapid-mixed high $NO_x$ flames. Elongated flames may them impinge on furnace walls leading to slag deposition, corrosion, and higher levels of unburned combustibles (flame chilling). These effects can have significant impacts on the operation, service life, and efficiency of combustion, respectively. Fuel staging is disclosed in U.S. Pat. No. 4,206,712.

To reduce flame length in low $NO_x$ burners, impellers can be installed at the exit of the coal nozzle. These serve to deflect the fuel jet, reducing axial fuel momentum and reducing flame length. However, $NO_x$ increases significantly. Another known burner disclosed in U.S. Pat. No. 4,400,151 separates the fuel jet into several streams which are accelerated and deflected at the nozzle exit. $NO_x$ performance is again improved, like the burner of U.S. Pat. No. 4,836,772 which uses an impeller. In addition, the burner in U.S. Pat. No. 4,400,151 provides for some fuel jet velocity control with questionable effectiveness. This design suffers from poor mechanical reliability.

Tests have shown the burner of U.S. Pat. No. 4,836,772 can produce a short flame with very low $NO_x$, however, very high secondary air swirl is required to counteract the fuel jet momentum. The high secondary air swirl requires prohibitively high burner pressure drop.

U.S. Pat. No. 4,768,948 discloses an annular nozzle burner which produces a compact flame parallel to the burner axis. U.S. Pat. No. 4,428,727 discloses a burner for solid fuels having an axially moveable element which can vary the size of an annular outlet gap from the nozzle. An axially adjustable impeller is disclosed in U.S. Pat. No. 3,049,085.

SUMMARY OF THE INVENTION

The present invention concerns a burner which can simultaneously achieve low $NO_x$ emissions with a relatively short flame. The burner generally resembles the burner disclosed in U.S. Pat. No. 4,836,772 (which is incorporated here by reference) with an axial coal nozzle and dual air zones surrounding the nozzle. However, the coal nozzle is altered to accommodate a hollow plug. A pipe extends from the burner elbow through the nozzle mixing device, which uses a conical diffuser. The coal/primary air (PA) mixture is dispersed by the conical diffuser into a pattern more fuel rich near the walls of the nozzle and fuel lean toward the center as in U.S. Pat. No. 4,380,202. The nozzle then expands to about twice the flow area compared to the inlet. As the nozzle expands, the hollow plug is expanded to occupy an area roughly equivalent to the inlet area of the nozzle. Therefore the fuel/PA mixture traveling along the outside of the hollow plug is at about the same velocity as at the entrance of the nozzle. The center pipe with hollow plug can be moved fore/aft relative to the end of the burner nozzle and thereby change the fuel/PA exit velocity from the nozzle.

Accordingly, an object of the present invention is to provide a burner for the combustion of coal, oil or gas, which comprises an axially moveable plug having a divergent cross section which is positioned within a nozzle pipe for carrying pulverized coal, the pipe also having a divergent cross section.

A further object of the present invention is to provide a burner which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

The only FIGURE in the drawing is a schematic sectional view of a burner constructed in accordance with the present invention.

DESCRIPTION OF THE PREFERRED EMBODIMENT

Referring to the drawing in particular, the invention embodied therein comprises a burner generally designated 10 which is particularly designed for burning a pulverized coal plus primary air mixture supplied at an elbow member 12 to a nozzle inlet 14. The nozzle inlet supplies the coal/primary air mixture to the inlet of a central nozzle pipe 16 which extends across a secondary air windbox 18 defined between a water wall 20 which acts as a boundary for a combustion chamber 22, and an outer burner wall 24 which has an access opening that is closed by a flange 17 of the nozzle pipe 16. Water tubes 26 from water wall 20 are bent to form a conical burner port 30 having a diverging wall extending into the combustion chamber 22. A conical diffuser 28 is positioned in the central nozzle pipe 16 for dispersing the coal/primary air mixture into a pattern which is more fuel rich near the inner surface or wall 32 of the nozzle pipe 16, and more fuel lean toward the outer wall 34 of a hollow plug 38 positioned in the central nozzle pipe 16. Although plug 38 is shown cross hatched, it is in fact hollow and contains various structures including for example, conduits for ignition means and for oil atomizers, shown only as an atomizer outlet 40 for discharging an atomized oil plus medium mixture 42 into the combustion chamber 22. The atomizing medium may be steam or air for example.

Drive means shown schematically at 44 are connected to the plug 38 for moving the plug axially in the fore and aft direction of the double arrow. This causes the outwardly diverging walls of outer plug surface 34 to move closer to or further away from the outwardly diverging walls of inner nozzle pipe surface 32, to change the velocity of exiting coal/primary air through an annular outlet nozzle 46 defined between the central pipe and the plug, and into the combustion chamber 22, in the direction of arrows 36.

Secondary air flows from windbox 18 in the direction of arrows 48 into an annular secondary air passage 50 defined between an outer surface of nozzle pipe 16 and an inner surface of a burner barrel 52. The annular inlet into secondary air passage 50 can be opened or closed by axially moving a slide damper 54 which is slidably mounted on the outer surface of pipe 16.

Secondary air passage 50, near combustion chamber 22, is divided into an outer annular passage 56 containing one or more swirling vanes 57, and an inner annular passage 58 containing one or more swirling vanes 59. Secondary air is thus discharged in an annular pattern around the exiting coal/primary air mixture through the burner port 30 into the combustion chamber 22.

With the plug positioned as shown, the fuel air mixture leaves the nozzle at 36 with a velocity similar to that of U.S. Pat. No. 4,836,772 and may pass through a flame stabilizing ring 60 to stabilize and accelerate combustion. However, as the fuel/PA leaves the nozzle the bluff body effect of the hollow plug 38 makes the adjacent flow streams pull in/recirculate to occupy this zone. This acts to effectively reduce the axial momentum of the fuel/PA jet. This zone remains fuel rich to achieve low $NO_x$ emissions. The reduced fuel jet momentum tends to reduce flame length for two reasons. One, the coal particles have more time to burn out per unit distance from the burner. Two, the reduced fuel jet momentum enables the surrounding swirling secondary air (with combustion by-products) to more readily penetrate and complete mixing with the fuel jet at a moderate distance from the burner.

The geometry of this arrangement enables variation of the burner nozzle exit velocity by simple repositioning the hollow plug 38 fore/aft relative to the end of the nozzle, consequently affecting $NO_x$ formation and flame length. Lower exit velocities can be achieved by partially retracting the hollow plug 38, shortening the flame.

This solves the problem of reducing flame length in a low $NO_x$ burner. An alternative sometime used to reduce flame length is to install an impeller at the exit of the burner nozzle. This causes the coal/PA to be deflected at an angle off the burner axis, thereby reducing axial momentum. Flame length is shortened in proportion to the flare angle of the impeller. The disadvantage of the impeller is that the fuel is unavoidably deflected into the secondary air streams surrounding the fuel jet. This diminishes the fuel rich zone during coal devolatilization and causes $NO_x$ to increase significantly, relative to the same burner without an impeller. The invention reduces fuel jet momentum as the flame develops by collapsing the fuel jet, keeping it fuel rich. Consequently $NO_x$ is kept low while the flame is shortened.

The principal advantage of the invention is described above, i.e., low $NO_x$ with reduced flame length. However, several other advantages are also achieved. One concerns the use of the burner with difficult to burn coals It has been demonstrated that low burner nozzle velocities facilitate combustion of "difficult" pulverized fuels, such as low volatile coal, high moisture lignite, and petroleum coke.

The burner of the invention can be made to behave like a so-called enhanced ignition dual register burner by retracting the hollow plug somewhat. This results in much lower fuel/PA velocities leaving the nozzle and increases residence time of the fuel on the ignition zone immediately downstream of the nozzle. However, the majority of coals burned in the U.S. and many other countries are readily burned without resorting to very low nozzle velocities. In fact, operation with very low nozzle velocities can result in flame flash-back into the nozzle, damaging the burner and potentially producing a hazardous condition. So another advantage is the ability to easily change nozzle velocity to accommodate changes in coal quality. Therefore this same burner could readily fire a difficult to burn coal or easily burned coals, by adjusting nozzle velocity.

Another advantage of the burner concerns the use of the "pipe and hollow plug" axially positioned in the coal nozzle. This device can serve as the housing for the burner ignitor and/or an auxiliary fuel element such as a main oil atomizer 40 or a main gas element. The pipe and plug serves as a convenient location for such equipment and facilitates the use of fuel staging principles for firing natural gas or fuel oil, by the axial location.

The device as shown in the FIGURE has cylindrical walls 64, 65 in the pipe, and 62, 63 on the hollow plug. These walls can be tapered instead to provide more adjustment to nozzle exit velocity.

The device as shown has a "hollow plug" the size of the burner nozzle inlet, with the burner nozzle exit being twice the area of the inlet. Other ratios of nozzle and plug areas may prove more efficient in some circumstances e.g. a "hollow plug" twice the area of the nozzle inlet and the nozzle exit three times the area of the inlet.

The pipe and plug could also be ducted at 66 and 67 to supply small quantities of air or recirculated flue gas to further reduce $NO_x$ or control flame shape.

While a specific embodiment of the invention has been shown and described in detail to illustrate the application of the principles of the invention, it will be understood that the invention may be embodied otherwise without departing from such principles.

What is claimed is:

1. A burner for the combustion of a pulverized coal fuel plus air mixture, comprising:

an nozzle pipe (16) having an inlet (14) for receiving a pulverized coal fuel plus primary air mixture, an outlet (36) for discharging the pulverized coal fuel plus primary air mixture, and an inner surface which diverges along at least part of the length of said pipe between said inlet and said outlet and which includes cylindrical portions upstream and downstream of the diverging portion of said pipe;

a plug extending axially in said nozzle pipe and defining an annular nozzle space in said pipe for the passage of the pulverized coal fuel plug primary air mixture, said plug having an outer surface which diverges along at least part of the length of said plug in said annular nozzle space and opposite the diverging portion of said pipe for diverting the pulverized coal fuel plus primary air mixture outwardly along said nozzle space and which includes cylindrical portions upstream and downstream of the diverging portion of said plug;

drive means connected to said pipe and said plug for moving said pipe and plug axially with respect to each other to change the cross-sectional area of the nozzle space at the diverging portions of said pipe and plug so the pulverized coal fuel plus primary air mixture moves at a different velocity near the diverging portions of the pipe and plug;

means for supplying ducted air from the outer surface of the plug at the diverging portions thereof into the annular nozzle space to reduce $NO_x$; and secondary air means extending around said pipe for supplying secondary air in an annular stream around the pulverized coal fuel plus primary air mixture discharged from said nozzle outlet.

2. A burner according to claim 1, including an elbow connected to said nozzle inlet for supplying the fuel plus primary air mixture to said inlet.

3. A burner according to claim 1, including a conical diffuser positioned within said nozzle space downstream of the nozzle inlet and upstream of the portions of the plug and pipe surfaces which diverge.

4. A burner according to claim 1, wherein said secondary air means comprises a barrel positioned around said nozzle pipe and defining an annular secondary air chamber around said nozzle pipe.

5. A burner according to claim 4, including means in said secondary air chamber for dividing said chamber into an inner annular chamber and an outer annular chamber, and at least one swirling vane in at least one of said inner and outer chambers.

6. A burner according to claim 1, wherein said nozzle pipe inner surface diverges to expand said outlet of said nozzle pipe to about twice the flow area when compared to that of said inlet.

7. A burner according to claim 1, wherein said plug outer surface diverges to expand said plug to occupy an area roughly equivalent to the inlet area of the nozzle pipe inlet.

8. A burner according to claim 1, wherein said nozzle pipe inner surface diverges to expand said outlet of said nozzle pipe to about three times the flow area when compared to that of said inlet.

9. A burner according to claim 8, wherein said plug outer surface diverges to expand said plug to occupy an area twice the area of the nozzle pipe inlet.

10. A burner for the combustion of a pulverized coal fuel plug air mixture, comprising:

an nozzle pipe (16) having an inlet (14) for receiving a pulverized coal fuel plus primary air mixture, an outlet (36) for discharging the pulverized coal fuel plus primary air mixture, and an inner surface which diverges along at least part of the length of said pipe between said inlet and said outlet and which includes cylindrical portions upstream and downstream of the diverging portion of said pipe;

a plug extending axially in said nozzle pipe and defining an annular nozzle space in said pipe for the passage of the pulverized coal fuel plug primary air mixture, said plug having an outer surface which diverges along at least part of the length of said plug in said annular nozzle space and opposite the diverging portion of said pipe for diverting the pulverized coal fuel plus primary air mixture outwardly along said nozzle space and which includes cylindrical portions upstream and downstream of the diverging portion of said plug;

drive means connected to said pipe and said plug for moving said pipe and plug axially with respect to each other to change the cross-sectional area of the nozzle space at the diverging portions of said pipe and plug so the pulverized coal fuel plus primary air mixture moves at a different velocity near the diverging portions of the pipe and plug;

means for supplying ducted air from the outer surface of the plug and the inner surface of the pipe at the diverging portions thereof into the annular nozzle space to reduce $NO_x$; and secondary air means extending around said pipe for supplying secondary air in an annular stream around the pulverized coal fuel plus primary air mixture discharged from said nozzle outlet.

11. A burner for the combustion of a pulverized coal fuel plus air mixture, comprising:

a nozzle pipe (16) having an inlet (14) for receiving a pulverized coal fuel plus primary air mixture, and outlet (36) for discharging the pulverized coal fuel plus primary air mixture, and an inner surface which diverges along at least part of the length of said pipe between said inlet and said outlet and which includes cylindrical portions upstream and downstream of the diverging portion of said pipe;

a plug extending axially in said nozzle pipe and defining an annular nozzle space in said pipe for the passage of the pulverized coal fuel plug primary air mixture, said plug having an outer surface which diverges along at least part of the length of said plug in said annular nozzle space and opposite the diverging portion of said pipe for diverting the pulverized coal fuel plus primary air mixture outwardly along said nozzle space and which includes cylindrical portions upstream and downstream of the diverging portion of said plug;

drive means connected to said pipe and said plug for moving said pipe and plug axially with respect to each other to change the cross-sectional area of the nozzle space at the diverging portions of said pipe and plug so the pulverized coal fuel plus primary air mixture moves at a different velocity near the diverging portions of the pipe and plug;

means for supplying recirculated gas from the outer surface of the plug at the diverging portion thereof into the annular nozzle space to reduce $NO_x$; and secondary air means extending around said pipe for supplying secondary air in an annular stream around the pulverized coal fuel plus primary air mixture discharged from said nozzle outlet.

12. A burner for the combustion of a pulverized coal fuel plus air mixture, comprising:

an nozzle pipe (16) having an inlet (14) for receiving a pulverized coal fuel plus primary air mixture, an outlet (36) for discharging the pulverized coal fuel plus primary air mixture, and an inner surface which diverges along at least part of the length of said pipe between said inlet and said outlet and which includes cylindrical portions upstream and downstream of the diverging portion of said pipe;

a plug extending axially in said nozzle pipe and defining an annular nozzle space in said pipe for the passage of the pulverized coal fuel plug primary air mixture, said plug having an outer surface which diverges along at least part of the length of said plug in said annular nozzle space and opposite the diverging portion of said pipe for diverting the pulverized coal fuel plus primary air mixture outwardly along said nozzle space and which includes cylindrical portions upstream and downstream of the diverging portion of said plug;

drive means connected to said pipe and said plug for moving said pipe and plug axially with respect to each other to change the cross-sectional area of the nozzle space at the diverging portions of said pipe and plug so the pulverized coal fuel plus primary air mixture moves at a different velocity near the diverging portions of the pipe and plug;

means for supplying recirculated gas from the outer surface of the plug and the inner surface of the pipe at the diverging portions thereof into the annular nozzle space to reduce $NO_x$; and secondary air means extending around said pipe for supplying secondary air in an annular stream around the pulverized coal fuel plus primary air mixture discharged from said nozzle outlet.

* * * * *